US008526272B2

(12) United States Patent
Kallestad

(10) Patent No.: US 8,526,272 B2
(45) **Date of Patent: *Sep. 3, 2013**

(54) DAY AND TIME CHRONOMETER MOVEMENT

(75) Inventor: John P. Kallestad, Incline Village, NV (US)

(73) Assignee: DayClocks, Inc., Sparks, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/483,960

(22) Filed: May 30, 2012

(65) Prior Publication Data

US 2012/0236692 A1 Sep. 20, 2012

Related U.S. Application Data

(63) Continuation of application No. 13/092,843, filed on Apr. 22, 2011, now Pat. No. 8,213,267, which is a continuation-in-part of application No. 10/789,388, filed on Feb. 28, 2004, now abandoned.

(51) Int. Cl.
*G04B 19/04* (2006.01)

(52) U.S. Cl.
USPC ..... 368/80; 368/28; 368/37

(58) Field of Classification Search
USPC ..... 368/28, 37, 80, 223
See application file for complete search history.

(56) References Cited

U.S. PATENT DOCUMENTS

| | | | | |
|---|---|---|---|---|
| 39,883 | A | 9/1863 | Carter | |
| 142,975 | A | 9/1873 | Worthley | |
| 249,536 | A | 11/1881 | Lewis | |
| 268,902 | A | 12/1882 | Jacquemin | |
| 309,257 | A | 12/1884 | Seem | |
| 422,090 | A | 2/1890 | Miller | |
| 2,651,166 | A | 9/1953 | Dorfman | |
| 2,741,082 | A | 4/1956 | Elberg | |
| 2,757,507 | A * | 8/1956 | Boyles | 368/37 |
| 5,062,090 | A | 10/1991 | Komiyama | |
| 5,177,712 | A | 1/1993 | Kakizawa | |
| 5,956,294 | A | 9/1999 | Takizawa | |
| D435,474 | S | 12/2000 | Benson | |

(Continued)

FOREIGN PATENT DOCUMENTS

GB 718896 11/1956

OTHER PUBLICATIONS

PCT Application No. PCT/US2012/034663, International Search Report and Written Opinion mailed Aug. 27, 2012.
U.S. Appl. No. 10/789,388, Office Action mailed Oct. 27, 2010.

(Continued)

*Primary Examiner* — Sean Kayes
(74) *Attorney, Agent, or Firm* — Lewis and Roca LLP

(57) ABSTRACT

A day clock has day, hour, and minute hands revolving continuously around a common center. It has a time adjustment knob and a day adjustment knob. When the day adjustment knob is pulled out, a set of gears are disengaged, allowing the day hand to be adjusted with that knob without affecting the other hands. Then, when the set of gears are reengaged, the time adjustment knob can be utilized to set the time of day. In order to set the day and time accurately, the user may first set the time to midnight with the time adjustment knob, pull out the day adjustment knob, set the day to a clock face line between days with that knob, push that knob back in, and then set the time to the correct time with the time adjustment knob.

6 Claims, 9 Drawing Sheets

(56) References Cited

U.S. PATENT DOCUMENTS

| | | | |
|---|---|---|---|
| 6,359,840 | B1 | 3/2002 | Evans |
| D458,556 | S | 6/2002 | Kallestad |
| 6,414,908 | B1 | 7/2002 | Kurasawa |
| 6,823,834 | B2 | 11/2004 | Benson |
| 8,213,267 | B2 | 7/2012 | Kallestad |
| 2005/0254349 | A1 | 11/2005 | Kallestad |
| 2006/0133216 | A1 | 6/2006 | Zachmann |
| 2007/0121426 | A1 | 5/2007 | Simonian et al. |
| 2011/0199864 | A1 | 8/2011 | Kallestad |

OTHER PUBLICATIONS

U.S. Appl. No. 10/789,388, Final Office Action mailed Mar. 24, 2010.
U.S. Appl. No. 10/789,388, Final Office Action mailed Oct. 26, 2009.
U.S. Appl. No. 10/789,388, Office Action mailed May 1, 2009.
U.S. Appl. No. 10/789,388, Office Action mailed Jan. 27, 2006.

* cited by examiner

DAY AND TIME CHRONOMETER MOVEMENT

CROSS-REFERENCE TO RELATED APPLICATIONS

This application is a continuation and claims the priority benefit of U.S. patent application Ser. No. 13/092,843 filed Apr. 22, 2011, which is continuation-in-part and claims the priority benefit of U.S. patent application Ser. No. 10/789,388, filed Feb. 28, 2004, the entireties of which are incorporated by reference herein.

BACKGROUND OF THE INVENTION

1. Field of the Invention

The present invention relates to chronometers and, more specifically, to a clock that displays a continuously moving day hand.

2. The Prior Art

Clocks and other types of chronometers have an ancient lineage. Some of the earlier clocks used peg and tooth gears in order to display hours and minutes somewhat accurately. More recently, many chronometers use gear trains of toothed gears to provide this feature.

Basic gears work on the principle that when two circles are turning with their edges at the same speed, their relative rotational speeds are a function of the difference in their circumference, which are, in turn, dependent upon their respective radii or diameters, through use of the equation C=2.pi.R (or C=.pi.D). Teeth around the edges of a circular gear are often utilized to eliminate slippage between the edges of the circular gears. This guarantees that the edges of the circular gears rotate at the same speed, and that torque from one gear to another is transferred without loss. One added feature of utilizing gears is that while the relative speed of the rotation of two intermeshing gears is based on the ratio of their respective diameters, the amount of torque transferred has an inverse ratio. Thus, if a first gear has 5 teeth around its circumference, and a second gear has 30 teeth similarly spaced around its circumference, the first gear will turn 6 times as fast as the first, but have ⅙ the torque. It should also be noted that since the edges are synchronized, the two gears rotate in opposite directions when engaged.

These features have long been utilized in clocks and other chronometers. Thus, a gear driving a minute hand and one driving an hour hand can be synchronized if the gear ratios between the two have a ratio of 60/1, and this can be accomplished utilizing a 5/1 and a 12/1 gear ratio or a 10/1 and a 6/1 gear ratio.

At one point in the past, gear trains consisting single gears that engaged and intermeshed were utilized in clocks and other chronometers. However, it was discovered that multiple gears could be fixably mounted on the same shaft, and that gear trains so constructed were simpler to construct and often easier to design and took up less space. Many mechanical clocks today utilize this feature, with most of their gears in their gear trains being constructed utilizing multiple gears mounted on common shafts, and with some of those shafts being utilized to drive the hands of the chronometers.

Many, if not most, mechanical or partially mechanical clocks and other chronometers today operate by having a drive gear that operates at a fairly high constant speed. Thus, a drive gear being driven by 120 cycle current in the U.S. would typically rotate 120 times per second. This rotation would be stepped down to 1 cycle or revolution per second for a "Second" gear through use of a set of gears providing a 120/1 gear ratio. The "Second" gear could then be stepped down to a "Minute" gear through use of a set of gears providing a 60/1 gear ratio, and an "Hour" gear through use of a set of gears again providing a 60/1 gear ratio. Attaching the "Hour", "Minute", and "Second" gears to hollow shafts of differing sizes, inserting one of these shafts into another, and then attaching hands to the these shafts, provides the familiar clock or watch face with hour, minute, and second hands rotating around a common center.

While clocks and other chronometers have long been capable of displaying hours, minutes, and seconds, chronometers displaying days of the week are much less common. One problem that has been difficult to solve is that of setting the day of the week. When setting, in particular, the hour and minute, it is common for clocks and other chronometers to provide this feature by manually rotating the minute hand completely for each hour that needs to be changed. Thus, in order to adjust the time forward by 2 hours and 15 minutes, one might rotate the minute hand around the dial 21/4 times. While laborious, this has long been considered acceptable overhead, given that clocks rarely need to be adjusted that much. But that approach does not work well when adopted to adjusting a day hand, because in order to adjust the day and time ahead by 3 days 2 hours and 15 minutes, one would need to rotate the minute hand 741/4 times (3*24+2+¼) around the clock face. This is one of the reasons that Day hands have not been seen in the past that were driven directly and continuously off of a gear train that also directly and continuously drives the Hour, Minute, and Second hands. Rather, chronometers that display the day of the week typically utilize some type of ratchet system, where the Day hand is effectively decoupled from the Hour, Minute, and Second gears.

It would thus be advantageous for there to be a mechanical clock utilizing a gear train that continuously drives a day hand at a constant speed utilizing the same gear train that drives hour and minute hands at a constant speed.

BRIEF SUMMARY OF THE INVENTION

This patent discloses and claims a useful, novel, and unobvious invention for a clock with a continuously moving day hand in the chronometer field.

A day clock has day, hour, and minute hands revolving continuously around a common center. It has a time adjustment knob and a day adjustment knob. When the day adjustment knob is pulled out, a set of gears are disengaged, allowing the day hand to be adjusted with that knob without affecting the other hands. Then, when the set of gears are reengaged, the time adjustment knob can be utilized to set the time of day. In order to set the day and time accurately, the user may first set the time to midnight with the time adjustment knob, pull out the day adjustment knob, set the day to a clock face line between days with that knob, push that knob back in, and then set the time to the correct time with the time adjustment knob.

DETAILED DESCRIPTION

Figure 1:
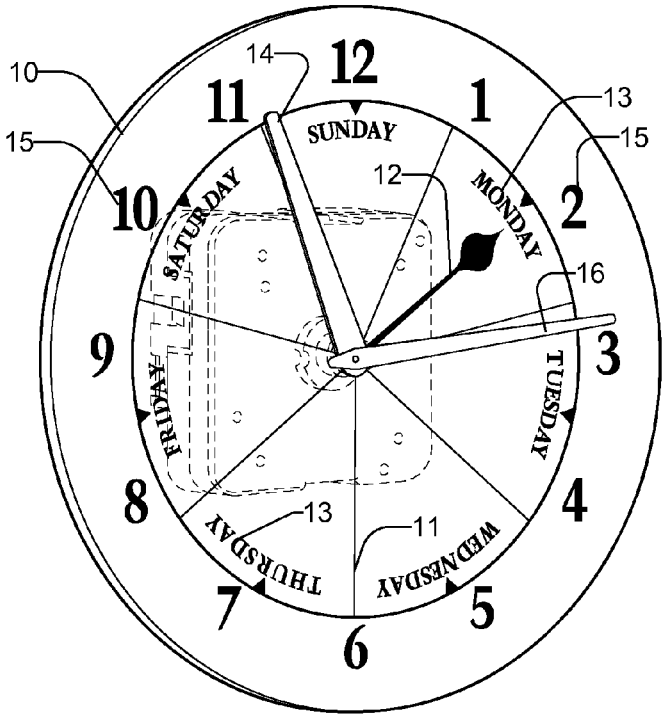
FIG. 1 is a front view of a day clock, in accordance with one embodiment of the present invention.

A Day Clock is a clock that displays the day of the week, along with possibly the hour, minute, and second. In this invention, the Day, Hour, Minute, and Second hands are mounted on concentric shafts, so that these hands can rotate simultaneously and continuously around a common center. A Time Adjustment Knob and a Day Adjustment Knob are provided. Pulling out the Day Adjustment Knob disengages the gears driving the Day hand from the gears driving the other hands. The Day hand can then be adjusted independently of the other hands utilizing this knob. This knob is then pushed in, reengaging the gears, allowing the Day hand to move along with the other hands, and to be adjusted along with the other hands by the Time Adjustment Knob.

In the following disclosure, multiple gears are most often mounted on a common shaft on what will be termed herein as a "gear assembly". A gear assembly will have one, two, or possibly more gears fixably attached to a common shaft, which may be solid or hollow, and may or may not be fixably attached to a longer shaft utilized to turn the clock hands or be turned by someone adjusting the day or time. In the embodiments of the present invention disclosed below, "Day", "Hour", "Minute", and typically "Second", gear assemblies are stacked, one on top of another, with each one having a long shaft, with those shafts inserted into each other, allowing the various hands to rotate around a common center.

When gears intermesh, engage, and interoperate, there is typically a "driving" gear and a "driven" gear. The "driving" gear transfers rotational torque to the "driven" gear. A "gear train" is a set or system of gears arranged to transfer rotational torque from one part of a mechanical system to another. In this disclosure, the term "gear train" is utilized to identify the set of interworking gears and gear assemblies between an initial driving gear to the gear assembly turning the day hand 12. The gear assemblies with multiple gears in the gear train are described below from the Day hand back to the driving gear. They will be describe however from the point of view of a "driving" and a "driven" gear. A "driving" gear provides rotational torque to a "driven" gear below it on the gear train. The original "driving" gear typically gains its torque and rotational speed from an electro-mechanical device such as an oscillator.

In this description, the "Second" gear will be the driving gear for the next gear in the gear train, and the "First" gear will be the driven gear, driven by the "Second" gear of the previous gear in the gear train. In the FIGs., the gear assembly themselves will be given a reference number without a suffix. The "First" (driven) gear will be given the suffix of "A", and the "Second" (driving) gear will be given the suffix of "B". Thus, for the second "Day" gear, the gear assembly is designated as "32", with the "First" (driven) gear being designated as "32A" and the "Second" (driving) gear being designated as "32B". It should be understood that this identification is solely for the purpose of description, and has no relevance to the functionality or structure of the claimed and disclosed invention. Also, in the situation of the initial driving gear and the Time Adjustment mechanism, there will not be shown a "driven" gear, and thus no "First" (driven) gear (with an "A" suffix). Similarly, the gear assembly that turns the Hour hand will not be shown having a "Second" (driving) gear (with a "B" suffix), since it is at the end of the gear train.

FIG. 1 is a front view of a day clock 10, in accordance with one embodiment of the present invention. The day clock 10 has a circular face and is shown with three hands rotating around a common center: a Day hand 12, an Hour hand 14, and a Minute hand 16. In other embodiments, a Second hand (not shown) is also incorporated. The outside of the face of the clock 10 is traditional, with, for example, hours 15 being designated and displayed in regular intervals around the circumference of the clock 10 face. Within the outer circumference of the clock face 10 with the digits for hours 15, are the names of the typically 7 days of the week 13 spaced evenly around the face of the clock. Also shown on the face of the clock are lines 11 separating the days of the week. In a preferred embodiment, with a 7 day week, there will be one line extending from the center of the clock with the hands 12, 14, 16, downward, and the remainder of these lines will be positioned accordingly. These lines typically identify midnight, and can be used to quickly and accurately adjust the hands on the clock.

Figure 2:
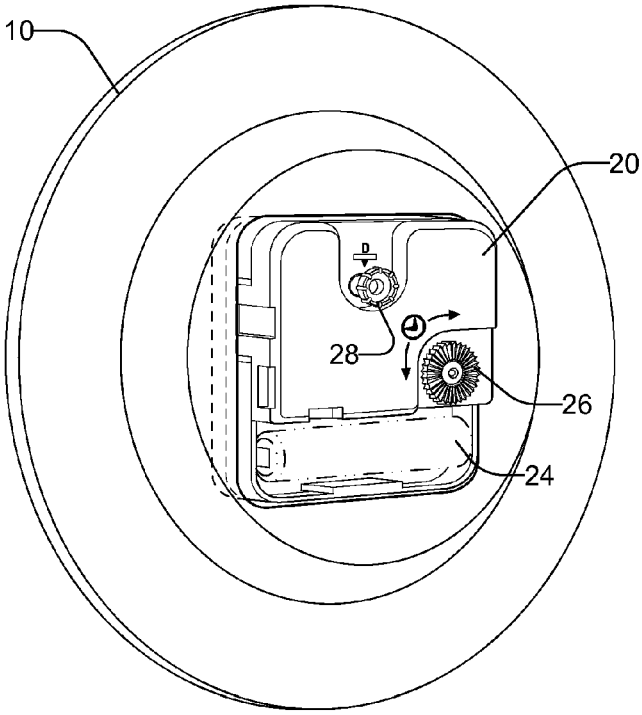
FIG. 2 is a rear perspective view of the day clock shown in FIG. 1.

FIG. 2 is a rear perspective view of the day clock 10 shown in FIG. 1. A movement 20 (shown as dashed lines in FIG. 1) drives the hands 12, 14, 16 of the clock. The movement 20 is powered by a battery 24, and has a Time Adjustment Knob 26 and a Day Adjustment Knob 28.

Figure 3:
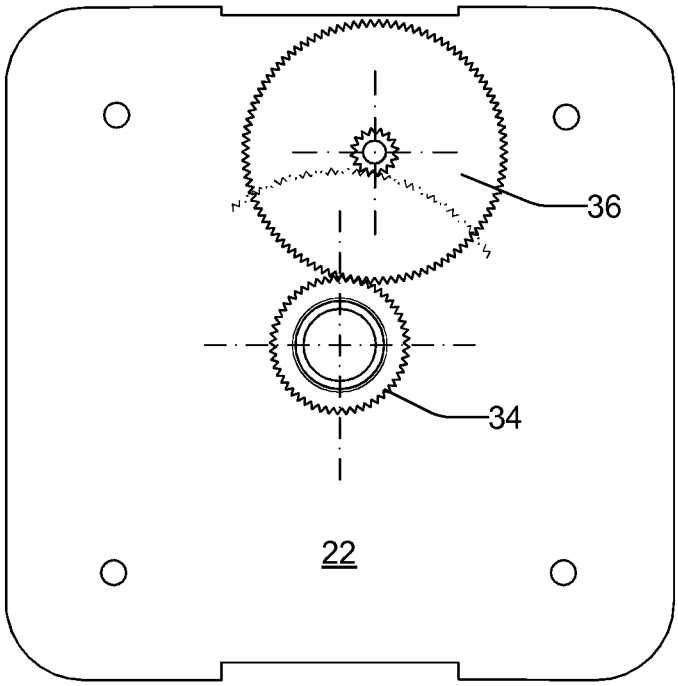
FIGS. 3-8 are top views of the movement with gear assemblies progressively added to show the structure of the gear assemblies within the movement.
Figure 4:
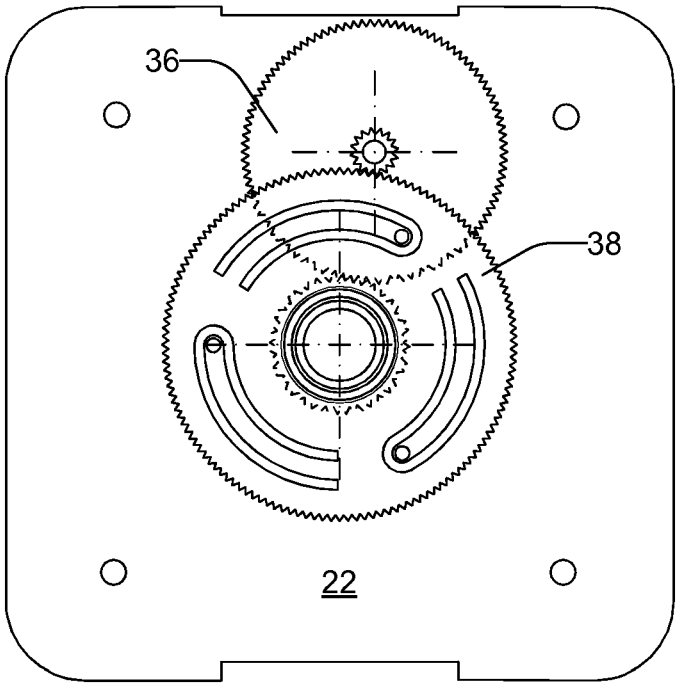
Figure 5:
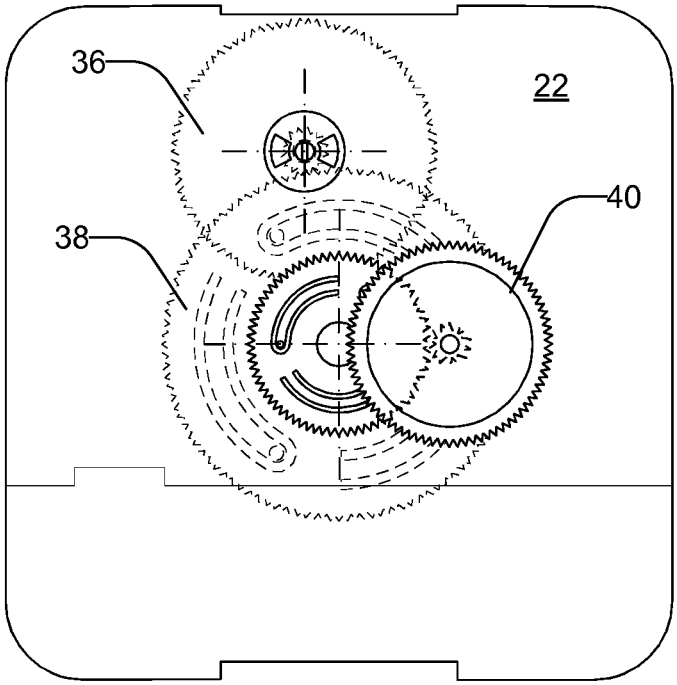
Figure 6:
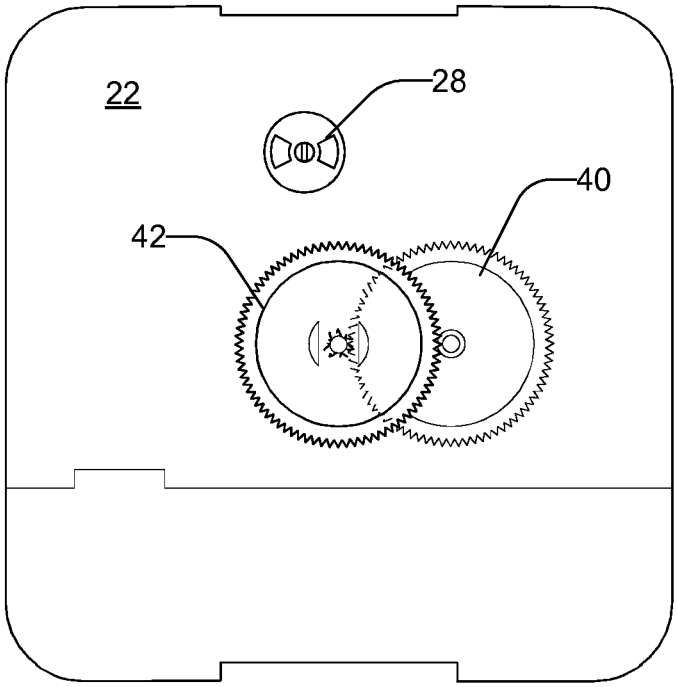
Figure 7:
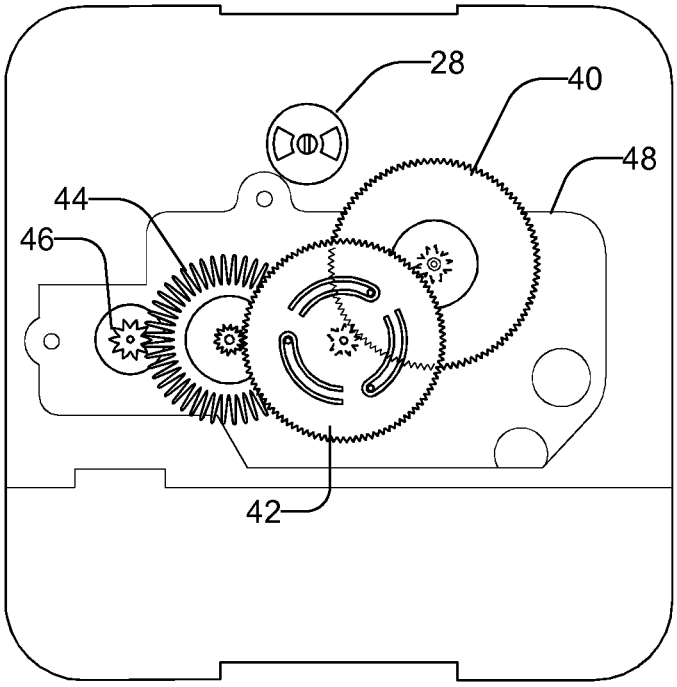
Figure 8:
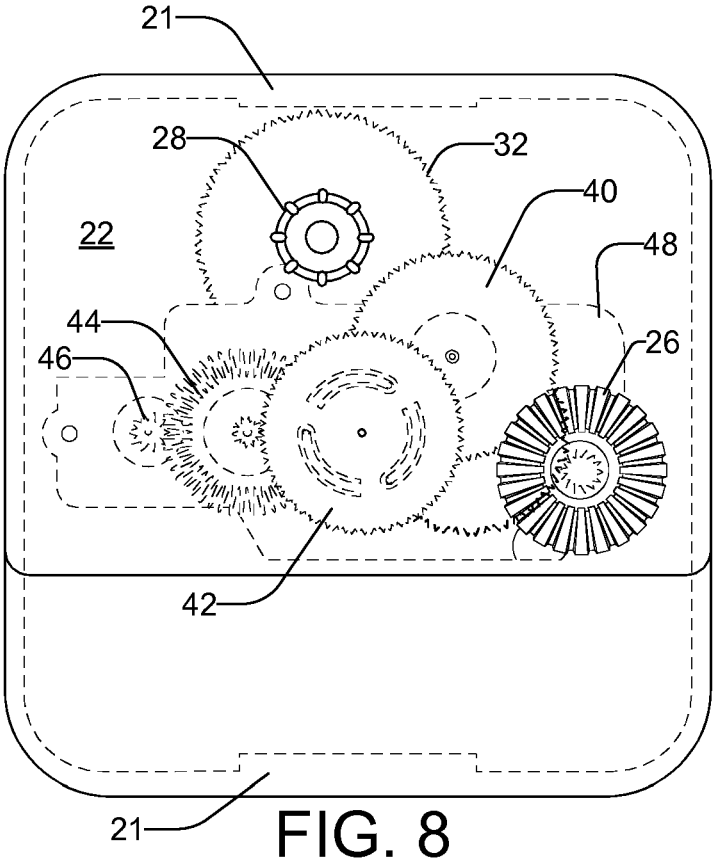

FIGS. 3-8 are top views of the movement 20 with gear assemblies progressively added to show the structure of the gear assemblies within the movement 20. FIG. 3 shows a second Hour gear assembly 34 engaging a first Hour gear assembly 36. FIG. 4 shows a second Minute gear assembly 38 engaging and driving the first Hour gear assembly 36. FIG. 5 shows the first Hour gear assembly 36 and a second Minute gear assembly 38, which engages and is driven by a first Minute gear assembly 40. FIG. 6 shows the first Minute gear assembly 40 engaging and being driven by a second Second gear assembly 42. FIG. 7 shows the first Minute gear assembly 40 and second Second gear assembly 42 installed on a mounting block 48. Also shown is a driving gear 46 engaging and driving a first Second gear assembly 44, which, in turn, engages and drives the second Second gear assembly 42. FIG. 8 shows the top of the movement 20 with the top and Time Adjustment Knob 26 and Day Adjustment Knob 28 attached. Shown as dashed lines within the movement 20 are a first Day gear assembly 32, first Minute gear assembly 40, second Second gear assembly 42, first Second gear assembly 44, driving gear assembly 46, and mounting block 48.

Figure 9A:
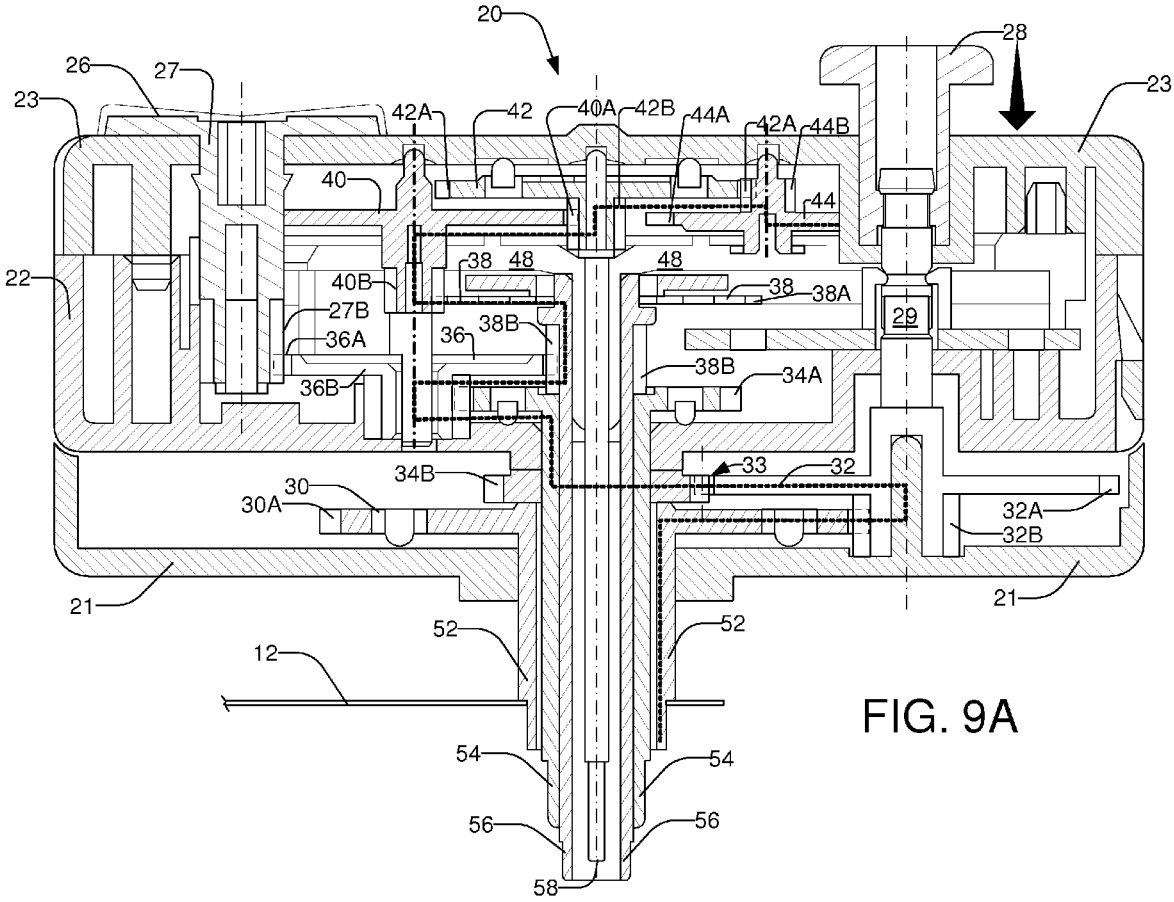
FIGS. 9A and 9B are side sectional views of the embodiment shown in FIGS. 1 and 2.
Figure 9B:
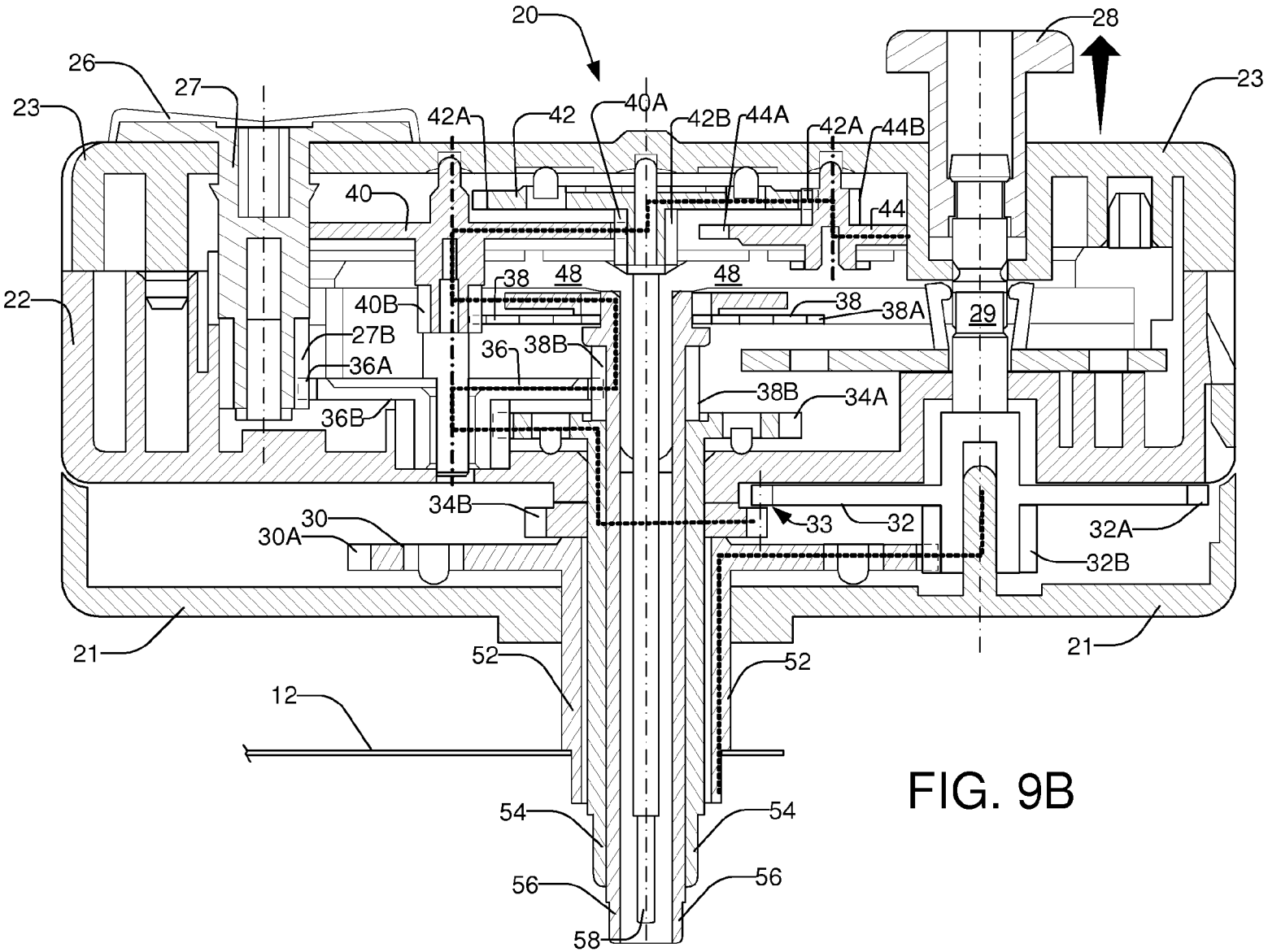

FIGS. 9A and 9B are side sectional views of the embodiment shown in FIGS. 1 and 2. FIG. 9A shows the movement with the day adjustment feature not engaged, and FIG. 9B shows the same view with the day adjustment feature engaged. As noted above, the description of the movement is from the gear driving the Day hand 12 back to an initial driving gear 46. Dotted lines show the drive gear train from a first Second gear assembly 44 to a Day hand shaft 52. Note that when the day adjustment feature is engaged, and the Day hand is disengaged from the clock's gear train, the drive gear chain stops at the point where the gears for the Day hand are disengaged from the remainder of the gear chain.

In this embodiment, the movement 20 case is constructed of plastic, and consists of three parts or sections. A lower part 21 contains primarily Day gear assemblies 30, 32. The lower part 21 is permanently attached to a middle part 22. A removable top part 23 snaps onto the middle part 22, and in the interior thus formed are mounted the remainder of the gear assemblies, as well as the electro-mechanical driver, which in this embodiment is a battery 24 operated oscillator (not shown). The bottom of the top part 23 is formed to hold the gear assemblies in place. The battery 24 fits in a separate compartment in the middle part 22, and is covered by a removable cap (not show), allowing for easy replacement of the battery 24.

The Day hand 12 is attached to a "Day" hand shaft 52 that is fixably connected to a second Day gear assembly 30 in the lower part 21 of the movement 20 case. Fixably attached to the second Day gear assembly 30 is a Day hand shaft 52, upon which the Day hand 12 is mounted. The second Day gear assembly 30 has a first gear 30A that engages and is driven by a second gear 32B of a first Day gear assembly 32. The first Day gear assembly 32 has a first gear 32A that selectively engages and is driven by a second gear 34B of a second Hour gear assembly 34. The second Hour gear assembly 34 is fixably connected to an Hour hand shaft 54 upon which an Hour hand 14 may be mounted. The Hour hand shaft 54 is inserted into the Day hand shaft 52. In this embodiment, the product of the ratios between gears 32B/30A and 34B/32A will typically be 24*7=168, so that the Hour hand 14 rotates 24 times for each time that the Day hand rotates to the next day. Since there are 7 days in a week, this means that the Day hand 12 rotates around the clock face at a rate of approximately 2.143.degree. per hour (360/168), while the Hour hand 14 rotates around the clock face at a rate of 360.degree. per hour.

The second Hour gear assembly 34 has a first gear 34A which engages and is driven by a second gear 36B of a first Hour gear assembly 36. The first Hour gear assembly 36 has a first gear 36A that selectively engages and is driven by a second gear 38B of a second Minute gear assembly 38. The second Minute gear assembly 38 is fixably connected to a Minute hand shaft 56 upon which a Minute hand 16 may be mounted. The Minute hand shaft 56 is inserted into the Hour hand shaft 54. In this embodiment, the product of the ratios between gears 36B/34A and 38B/36A will typically be 60, so that the Minute hand 16 rotates 60 times for each time that the Hour hand 14 rotates to the next hour.

The second Minute gear assembly 38 has a first gear 38A which engages and is driven by a second gear 40B of a first Minute gear assembly 40. The first Minute gear assembly 40 has a first gear 40A that selectively engages and is driven by a second gear 42B of a second Second gear assembly 42. The second Second gear assembly 42 may be fixably connected to a Second hand shaft 58 upon which a Second hand (not shown) may be mounted. The Second hand shaft 58 may be inserted into the Minute hand shaft 56. In this embodiment, the product of the ratios between gears 40B/38A and 38B/36A will typically be 60, so that the Second hand rotates 60 times for each time that the Minute hand 16 moves to the next minute.

The second Second gear assembly 42 has a first gear 42A which engages and is driven by a second gear 44B of a first Second gear assembly 44. The first Second gear assembly 44 has a first gear 44A that selectively engages and is driven by a second gear of a driving gear assembly 46 (better shown in FIG. 8). The driving gear assembly 46 is typically driven by a rotational source that advances the teeth of the second gear at a specified rate. In the case of a clock attached to 120 cycle electricity, the driving gear will thus rotate 120 times a second. The gear ratios between the driving gear 46, the first Second gear assembly 44 gears, and the second Second gear assembly 42 first gear 42A will depend on the rotational speed of the driving gear 46. In this embodiment, the driving gear 46 is driven by an electro-mechanical device (not shown) powered by a battery 24.

Also, in this embodiment is shown a Time Adjustment Knob 26 coupled by a shaft 27 having a second (driving) gear 27B. This engages the first gear 36A of the first Hour gear assembly 36, allowing the minutes and hours to be adjusted by rotating the first Hour gear assembly 36 in a forward or reverse direction.

Also shown in this embodiment is a Day Adjustment Knob 28 which is connected by a shaft 29 to the first Day gear assembly 32. Pulling the Day Adjustment Knob 28 out and pushing it in allows the first Day Gear assembly 32 to selectively disengage and engage with the second gear 34B of the second Hour gear assembly 34. FIG. 9A shows the Day Adjustment Knob 28, shaft 29, and first Day gear assembly 32 in a depressed, lowered, and engaged position. FIG. 9B shows the Day Adjustment Knob 28, shaft 29, and first Day gear assembly 32 in a raised and disengaged position. When an operator pulls the Day Adjustment Knob 28 out, the first gear of the first Day gear assembly 32 is raised above the second gear 34B of the second Hour gear assembly 34, disengaging the two gears 33. In this position, rotating the Day Adjustment Knob 28 acts to rotate the second Day gear assembly 30, attached Day hand shaft 52, and Day hand 12, without rotating any of the gear assemblies above in the gear train. Then, when the operator pushes the Day Adjustment Knob 28 back in, the first Day gear assembly 32 descends, and the first gear 32A of the first Day gear assembly 32 engages 33 the second gear 34B of the second Hour gear assembly 34, and allows the Hour hand 14 to be driven by the drive train, along with the other hands 14, 16.

Figure 10A:
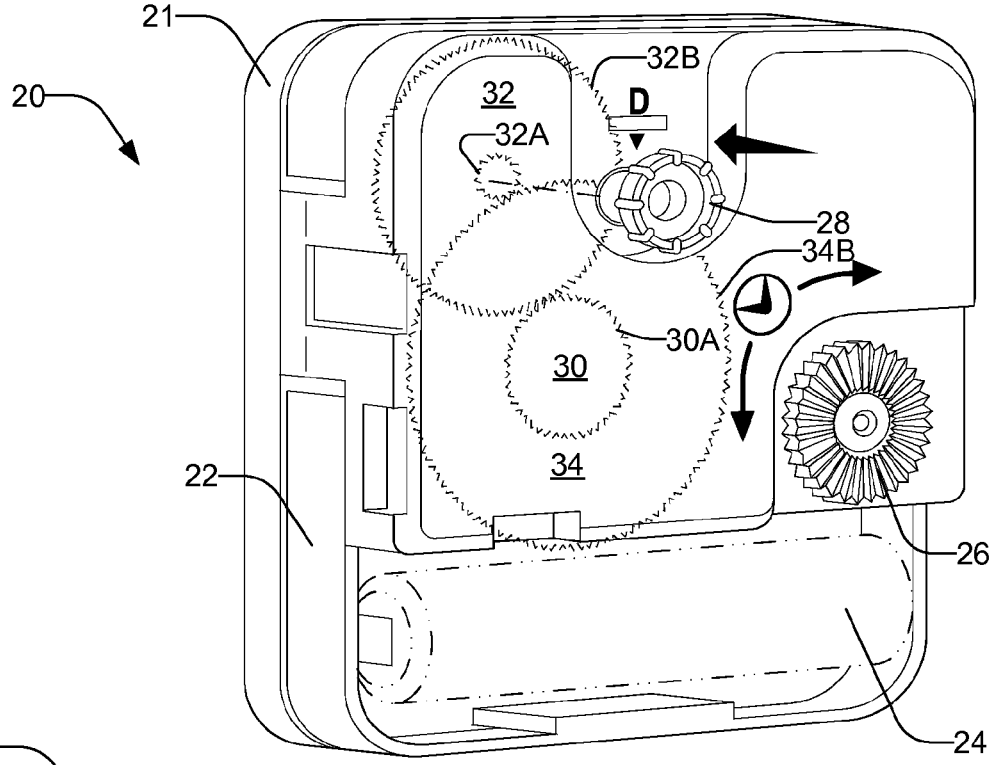
FIGS. 10A and 10B are rear perspective views of the movement shown in FIGS. 1 and 2.
Figure 11A:
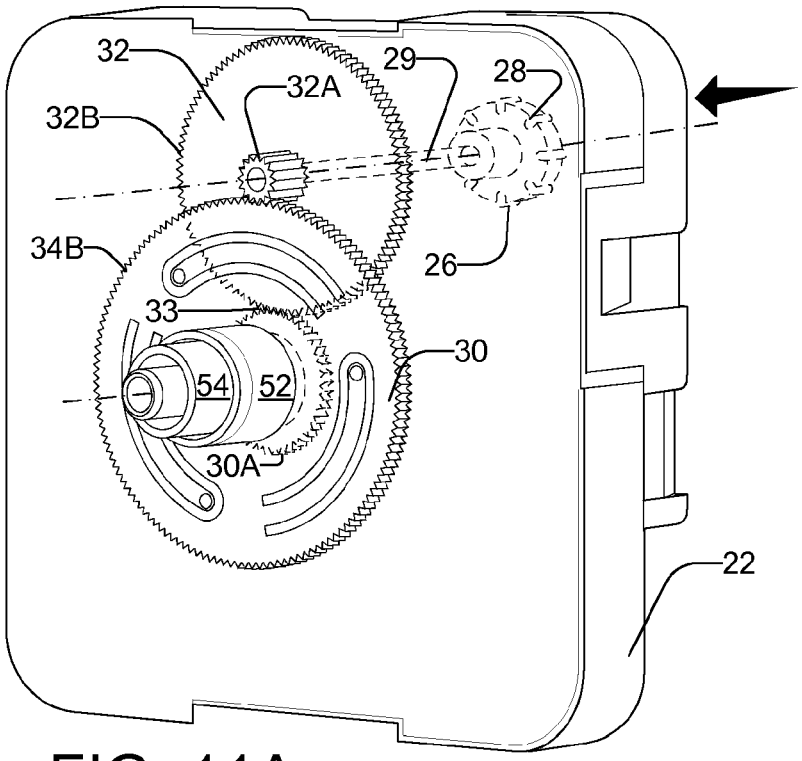
FIGS. 11A and 11B are rear perspective views of the movement shown in FIGS. 1 and 2.
Figure 10B:
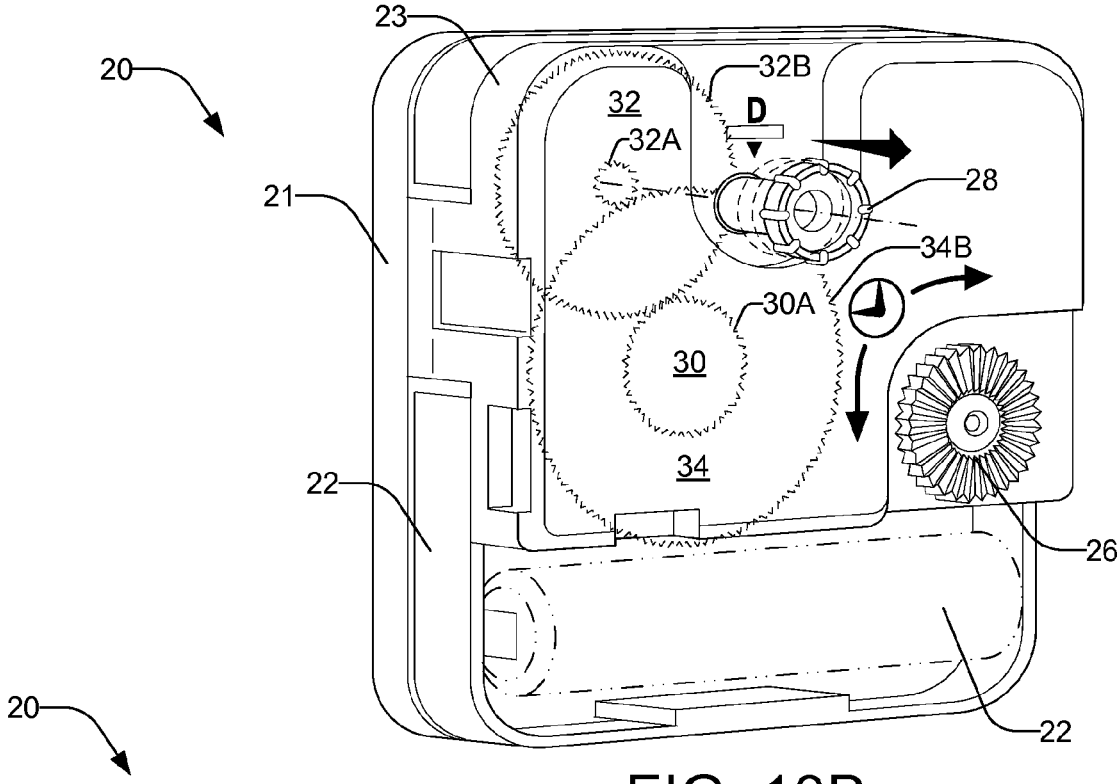
Figure 11B:
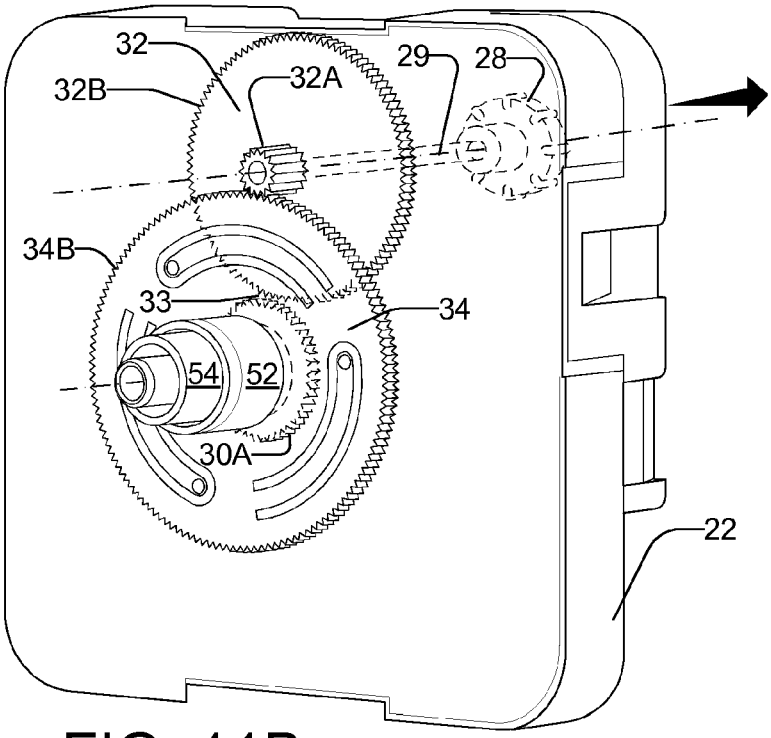

FIGS. 10A and 10B are top perspective views of the movement shown in FIGS. 1 and 2. FIGS. 11A and 11B are bottom perspective views of the movement shown in FIGS. 1 and 2. These FIGs. further illustrate the operation of engaging and disengaging the Hour hand portion of the gear train in order to adjust the Day without adjusting the Time. FIGS. 10A and 11A show the first gear 32A of the first Day gear assembly engaged with the second gear 34B of the second Hour gear assembly 34, when the Day Adjustment Knob 28, shaft 29, and first Day gear assembly 32 are in an lowered position as a result of a user pushing down on the Day Adjustment Knob 28. FIGS. 10B and 11B show the first gear 32A of the first Day gear assembly disengaged 33 from the second gear 34B of the second Hour gear assembly 34, when the Day Adjustment Knob 28, shaft 29, and first Day gear assembly 32 are in a raised position as a result of a user pulling out or up on the Day Adjustment Knob 28.

It should be understood that the above day clock 10 and movement 20 is exemplary, and others are also within the scope of the present invention. For example, a second hand may be included, and if included, a Second hand shaft 58 would typically be fixably attached to a Second gear assembly 42, 44. On the other hand, the Second hand and Second hand shaft 58 may be omitted, and if so, then there is no requirement that one of the Second gear assemblies be stacked above the Minute, Hour, and Day gear assemblies.

Figure 12:
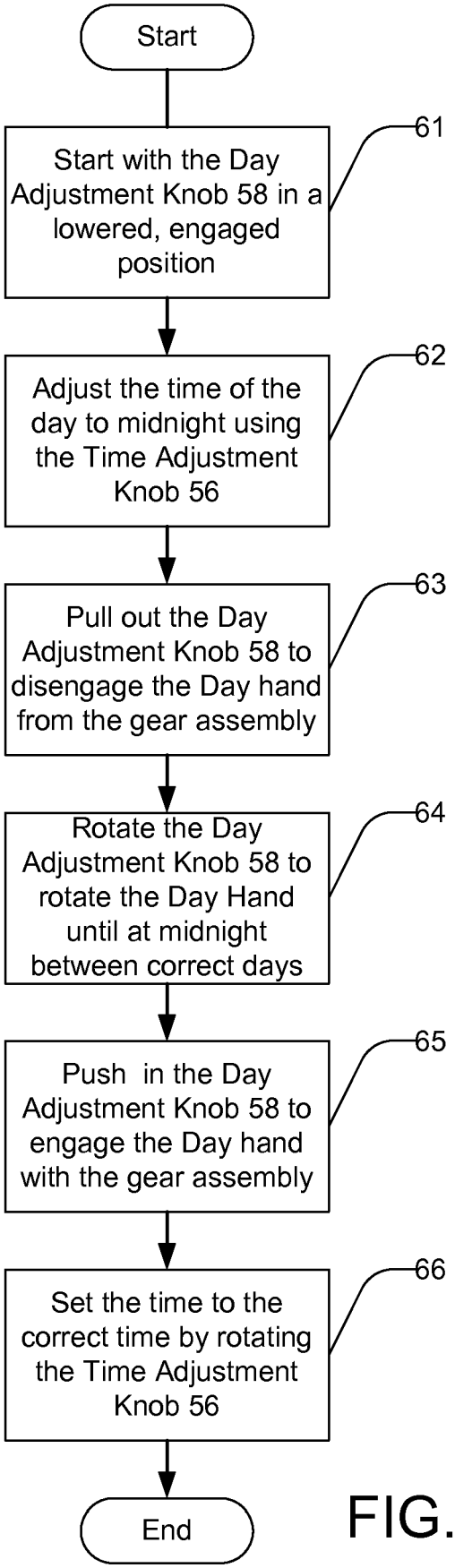
FIG. 12 is a flowchart illustrating a setting of day and time, in accordance with one embodiment of the present invention.

FIG. 12 is a flowchart illustrating a setting of day and time, in accordance with one embodiment of the present invention. In order to set the day and time utilizing the present invention, one may start with the Day Adjustment Knob 28 depressed, with the Day gear assemblies 30, 32, fully engaged with the remainder of the gear train, step 61. One could then adjust the time of day to noon or midnight (the same on most clocks), step 62. Next, one could pull out the Day Adjustment Knob 28, disengaging the Day gear assemblies 30, 32, from the rest of the gear train, step 63. Next, the day of the week could then be adjusted by rotating the Day Adjustment Knob 28, step 64. Preferably, the adjustment of the Day hand 12 is to one of the lines 11 displayed on the front of a day clock 10. The lines 11 typically represent midnight between two days. Then, the Day Adjustment Knob 28 is depressed, step 65, engaging the Day gear assemblies 30, 32, and Day hand 12 with the rest of the gear train. Finally, the time can be adjusted utilizing the Time Adjustment Knob 26, step 66. One advantage of this method, in conjunction with the clock 10 with movement 20 disclosed above, is that it is easy to identify whether a specific time is AM or PM by the position of the Day hand 12. It should be understood that this method is exemplary, and other methods are also within the scope of the present invention.

Those skilled in the art will recognize that modifications and variations can be made without departing from the spirit of the invention. Therefore, it is intended that this invention encompass all such variations and modifications as fall within the scope of the appended claims.

What is claimed:

1. A clock comprising:

a first hand to indicate a day of the week, the first hand mounted on a first shaft installed through a center of a face, the first shaft connected to a first day gear assembly, the first day gear assembly driven by and engaged with a second day gear assembly, a second hand to indicate an hour of the day, the second hand mounted on a second shaft connected to a first hour gear assembly, the second shaft installed and rotating within the first shaft, and a day adjustment system comprising a day adjustment knob for adjusting the first hand indicating the day of the week, the day adjustment system having two axial positions defining:

a first mode for normal operation, wherein the first day gear assembly and a second hour gear assembly of the second shaft are engaged to link rotation of the first and second hands, and a second mode for adjusting the day of the week, wherein the first day gear assembly is not engaged to the second hour gear assembly and wherein operation of the knob adjusts the first hand independent of the second hand.

2. The clock of claim 1, further comprising a circular face indicating a plurality of days and a plurality of hours.

3. The clock of claim 1, further comprising a third hand to indicate a minute of the hour, the third hand mounted on a third shaft permanently connected to a first minute gear assembly, the third shaft installed and rotating within the second shaft.

4. The clock of claim 1, further comprising a time adjustment system comprising a time adjustment knob for adjusting a time, wherein:

the first day gear assembly and the second day gear assembly are caused to rotate in a corresponding manner by the first hour gear assembly when the day adjustment system is in the first mode; and the first day gear assembly is not driven by the hour gear assembly when the day adjustment system is in the second mode.

5. The clock of claim 1, further comprising a fourth hand to indicate a second of the day, the fourth hand mounted on a fourth shaft permanently connected to a first second gear assembly, the fourth shaft installed and rotating within the third shaft.

6. The clock of claim 1, wherein the first hand moves about the first shaft at a rate of 360/168 degrees per hour.

* * * * *